United States Patent [19]

Orlowski

[11] Patent Number: 4,749,197

[45] Date of Patent: Jun. 7, 1988

[54] GOLF CLUB

[76] Inventor: David C. Orlowski, 3407 78th Ave. West, Rock Island, Ill. 61201

[21] Appl. No.: 24,466

[22] Filed: Mar. 11, 1987

[51] Int. Cl.[4] ..... A63B 53/04

[52] U.S. Cl. ..... 273/173; 273/167 H

[58] Field of Search ..... 273/78, 173, 174, 167 J, 273/167 H, 167 F, 169, 170, 171, 172, 175

[56] References Cited

U.S. PATENT DOCUMENTS

| | | | |
|---|---|---|---|
| 925,389 | 6/1909 | Royce | 273/78 |
| 2,846,228 | 8/1958 | Reach | 273/173 X |
| 3,834,700 | 9/1974 | Averbach | 273/173 X |

*Primary Examiner*—George J. Marlo

*Attorney, Agent, or Firm*—Y. Judd Azulay

[57] ABSTRACT

A golf club having a shaft and a head. The head having a striking face with a titanium face plate thicker at its perimeter inserted into the striking face of the golf club head. The face plate also having a recess on the rear portion of said face plate.

4 Claims, 1 Drawing Sheet

GOLF CLUB

BACKGROUND OF THE INVENTION

The invention relates to golf clubs and particularly to titanium face plates in golf club heads.

Golf clubs have been in existence for many years. People have constantly attempted to improve the distance a golf ball will travel after striking. Many different materials of different degrees of hardness and therefore different degrees of compressibility upon impact with a golf ball, have been used.

The most common inserts in the market today include epoxy, cycolac, graphite, phenolic, glass, fiber and aluminum. In tests performed comparing all these inserts, it was determined that all the inserts performed essentially the same.

Many different patents have issued describing different golf club inserts. U.S. Pat. Nos. 3,834,700 and 3,367,228 describe face plates having a high modulus of elasticity. One such face plate mentioned is titanium and carbides of titanium.

U.S. Pat. No. 2,846,228 refers to iron type golf clubs. In that patent, reference is made to titanium due to its low specific gravity.

Other patents, such as U.S. Pat. Nos. 1,589,363; 1,592,463; 3,212,783; 3,368,812; 3,989,248; and 4,181,306 refer to different type inserts, including aluminum, steel, bronze, plastic and sodium-aluminum salicate. Each different type insert is described for its own specific properties, such as a light metal alloy or having a high yield strength.

A reading of the prior patents or an intensive review of all golf clubs presently marketed, fails to disclose a golf club head having a titanium insert in its striking surface wherein said insert also has a recess in its rear portion.

Factors which control the distance a golf club travels include the hardness of the striking surface and the flexibility of the striking surface. Accordingly, it is an object of this invention to fabricate a face plate for a golf club of a material that possesses a great hardness factor, durability and flexibility on its striking surface.

A further object of this invention is to provide a striking surface having a face plate with a recess adjacent a rear portion of the face plate. With such a recess flexing of the face plate is toward the middle of the face plate. Also, with such a face plate, the hardness and duraability of titanium is maintained with the additional advantage that the weight of a lighter material such as plastic, fiber or aluminum is used.

Having flexing toward the middle allows for the face plate to resume its original profile after striking the golf ball. Thus, greater strength and energy are imparted to the golf ball and both the distance travelled and the trajectory are improved.

It has been found that titanium has both a high durability factor as well as a high yield strength. Accordingly, still another object of the invention is to provide a face plate having both a high durability and high yield strength.

The invention possesses other advantages which will be apparent from the following description and the drawings.

SUMMARY OF THE INVENTION

The invention comprises a "wood" type golf club having a shaft and a head. The head includes a striking face which has a titanium face plate inserted therein. The titanium face plate is thicker about its perimeter than at its center. Thus, a recess is formed at the face plate center on the rear portion of the insert. The face plate is held in place by holding means such as screws placed away from the striking area of the striking face.

DESCRIPTION OF THE PREFERRED EMBODIMENT

Figure 1:
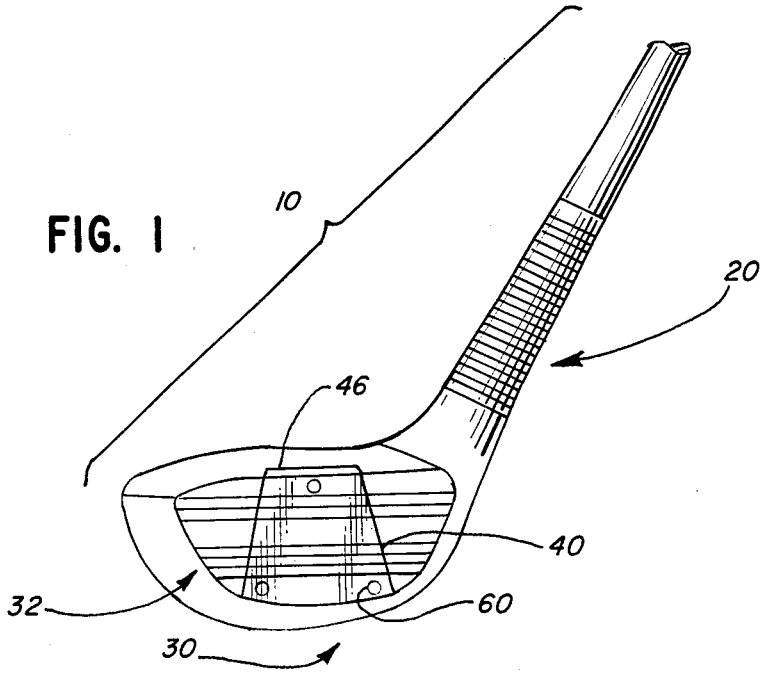
FIG. 1 is a perspective view showing a golf club fabricated with a titanium face plate in its striking surface.

Referring to FIG. 1, one will note a golf club 10 having two parts, a shaft 20 and a head 30. The head 30 is generally fabricated from a hard wood in a conventional or classic shape for golf clubs designated as "woods".

The head 30 has a portion with which a golf ball is hi. Such portion is referred to as the striking face 32. In an appropriate recess in the striking face 32 a titanium face plate 40 is inserted. The face plate 40 is constructed such that the width of the plate 40 is broader at its lower portion 48 than at its upper portion 46. Further, the face plate 40 is maintained in place with holding means such as screws 60.

Figure 3:
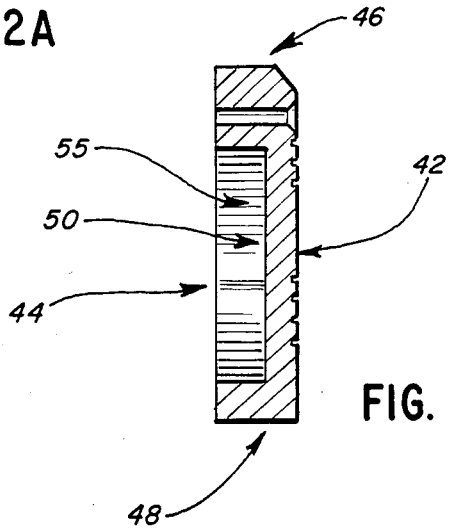
FIG. 3 is a vertical cross section of the titanium face plate taken along 3—3 of FIG. 2A.

In FIG. 3, the titanium face plate 40 is seen in cross section. It will be noted that the face plate 40 has a front portion 42 and a rear portion 44. It will also be noted that the upper portion 46 and the lower portion 48 are of greater thickness than the central portion 50. The sides are also made of a greater thickness than the central portion 50. Thus, due to the thickness about the periphery of central portion 50, a recess 55 is formed in the rear portion 44 between the sections comprising the periphery, namely, side upper and lower portions, 46, 48.

It has been observed that the maintenance of the recess 55 allows for flexing of the face plate to the middle. Further, such empty recess 55, because of the high strength of titanium, allows for the imparting of greater impulse to the golf ball, as well as the correction of the golf ball flight to the center. Further, it has been observed, that due to the solid, two piece golf balls currently in use, a greater amount of abrasion of the golf club striking surface is apparent. The use of the hard, high strength, durable titanium insert minimizes the detrimental effect of the harder ball impacting the striking surface.

The above mentioned factors are important to the golfer. It is believed that due to the titanium being durable, light weight and of high yield strength, the previously mentioned advantages occur.

Titanium is found in nature is a silvery solid or dark gray amorphous powder having a density of 4.59 g/cc. It has a high melting and boiling point. Further, it is known to be as strong as steel but 45% lighter. In addition, the corrosion resistance of titanium alloys is superior to aluminum and stainless steel.

As discussed above, the titanium is extremely hard and thus resistant to breakage and abrasion. Accordingly, a golf club head 30 having a titanium face plate 40 in its striking face 32 is provided. The face plate 40 is harder than the wood to which it is attached. Thus, an increased golf ball driving capacity is provided.

Figure 2A:
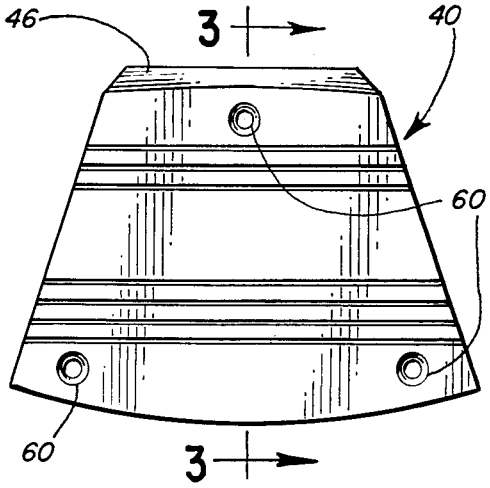
FIG. 2A is a perspective view of one embodiment of the titanium face plate.
Figure 2B:
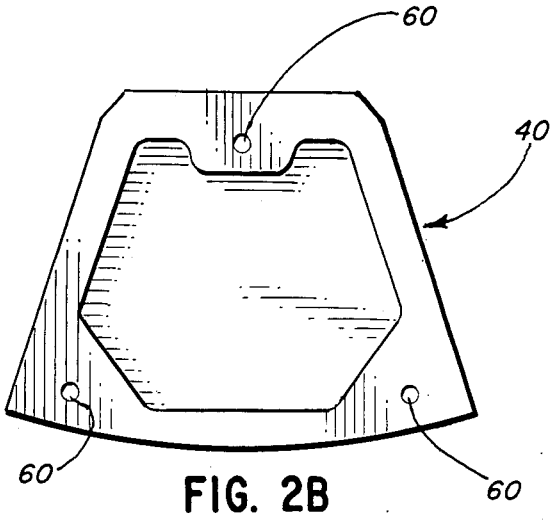
FIG. 2B is a perspective view of the rearward portion of the titanium face plate.

FIGS. 2A sets out one of the various forms of the inventive titanium face plate 40. It will be noted that the screws 60 are placed away from the center of the face plate 40. Obviously, the reason is to prevent a golfer from hitting a golf ball with any portion of the striking face 32 other than the face plate 40. It will also be noted that the titanium face plate 40 is broader at its lower portion 48 than its upper portion 46. This is in keeping with standard golf club practice which allows for a greater striking surface at the base of the head 32 rather than at the top of head 32.

Having thus described the invention, what is claimed is:

1. A golf club comprising in combination a shaft and a head, said head comprising a striking face and, a titanium face plate inserted in said striking face being thicker about its periphery than at its central portion, said face plate having an empty front and rear central portion and a recess in the rear portion of said face plate.

2. The golf club of claim 1 wherein said titanium face plate is broader at its lower portion than its upper portion

3. The golf club of claim 1 wherein said titanium face plate has holding means placed away from the striking area of said face plate.

4. The golf club of claim 1 wherein said recess lies between the thickened side, upper, and lower portions on the rear portion of said titanium face plate.

* * * * *

UNITED STATES PATENT AND TRADEMARK OFFICE

CERTIFICATE OF CORRECTION

PATENT NO. : 4,749,197

DATED : June 7, 1988

INVENTOR(S) : David C. Orlowski

It is certified that error appears in the above—identified patent and that said Letters Patent is hereby corrected as shown below:

Column 4, line 4, delete "and"; line 5, after "face", insert --and--; line 7, change "an empty" to --a--, and delete "central"; and line 8, change "a" to --an empty--, and after "rear", insert --central--.

Signed and Sealed this

Twelfth Day of November, 1991

*Attest:*

HARRY F. MANBECK, JR.

*Attesting Officer*

*Commissioner of Patents and Trademarks*